US008165504B2

(12) United States Patent
Cho

(10) Patent No.: US 8,165,504 B2
(45) Date of Patent: Apr. 24, 2012

(54) TONER CARTRIDGE GUIDE UNIT HAVING TONER CARTRIDGE LIFTING UNIT AND IMAGE FORMING APPARATUS HAVING THE SAME

(75) Inventor: Hang-min Cho, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1041 days.

(21) Appl. No.: 12/099,276

(22) Filed: Apr. 8, 2008

(65) Prior Publication Data

US 2008/0310883 A1 Dec. 18, 2008

(30) Foreign Application Priority Data

Jun. 15, 2007 (KR) ..... 10-2007-0059118

(51) Int. Cl.
*G03G 15/08* (2006.01)

(52) U.S. Cl. ..... 399/258

(58) Field of Classification Search ..... 399/119, 399/120, 258, 260
See application file for complete search history.

(56) References Cited

U.S. PATENT DOCUMENTS 5,640,229 A * 6/1997 Nakahara ..... 399/119
6,510,306 B2 1/2003 Ashikari
2002/0064401 A1 * 5/2002 Ashikari ..... 399/258
2005/0044713 A1 3/2005 Fromm et al.

FOREIGN PATENT DOCUMENTS

EP 1 211 570 A2 6/2002
EP 1 331 527 A1 7/2003
JP 08152774 6/1996
JP 2000187377 7/2000
JP 2002-169364 6/2002

OTHER PUBLICATIONS

Office Action issued in Japanese Patent Application No. 2008-155351 on Sep. 20, 2011.
European Search Report issued Oct. 15, 2008 in Europe Application No. 08102953.0.

* cited by examiner

*Primary Examiner* — David Gray
*Assistant Examiner* — Billy J Lactaoen
(74) *Attorney, Agent, or Firm* — Stanzione & Kim, LLP

(57) ABSTRACT

A toner cartridge guiding unit includes a guide frame to guide mounting of a toner cartridge, and having a toner feed hole formed opposite to a toner discharge hole of the toner cartridge, a toner sealing member attached to the proximity of the toner feed hole, and a lifting unit to raise the toner cartridge so that the toner cartridge does not interfere with the toner sealing member during mounting. Because the toner sealing member is not damaged by the repeated mounting and demounting of the toner cartridge, toner is supplied efficiently from the toner cartridge, without leaking towards the guide frame.

14 Claims, 7 Drawing Sheets

TONER CARTRIDGE GUIDE UNIT HAVING TONER CARTRIDGE LIFTING UNIT AND IMAGE FORMING APPARATUS HAVING THE SAME

CROSS-REFERENCE TO RELATED APPLICATIONS

This application claims priority under 35 U.S.C. §119 (a) from of Korean Patent Application No. 10-2007-0059118, filed on Jun. 15, 2007, in the Korean Intellectual Property Office, the disclosure of which is hereby incorporated herein in its entirety by reference.

BACKGROUND OF THE INVENTION

1. Field of the Invention

The present general inventive concept relates to an image forming apparatus, and more particularly, to a toner cartridge guide unit capable of restraining toner leakage by repeated mounting and demounting of a toner cartridge, and an image forming apparatus having the same.

2. Description of the Related Art

A toner unit of an especially small-size image forming apparatus generally houses toner therein. This small type image forming apparatus also generally has an integrated structure of a developing unit including a toner unit, a developing medium, a developing roller, a supplying roller and a cleaning unit. Therefore, the developing unit itself was replaced with a new one, when the toner is used up.

It is especially inefficient and financially burdensome for a user who uses up the toner frequently and thus has to exchange the toner unit also frequently. It is also a waste of resources because other parts, such as a photosensitive medium or a developing roller, is also disposed altogether with the toner unit when the toner is used up.

Therefore, it will be more efficient to separate a toner cartridge holding toner therein from a developing unit for an image forming apparatus, so that a user can save expenditure.

FIG. 1 illustrates an image forming apparatus having the structure explained above. A color image forming apparatus has a plurality of color toner cartridges 100, such as cyan, magenta, yellow, black toner cartridges, in a main body 101, a feeding unit 102 housing a plurality of paper sheets, and other necessary components such as a developing unit, a fusing unit and a discharge unit although these are not illustrated in the drawing.

Referring to FIG. 2, each of the developer cartridges 100 is mounted along a guide frame 10 which is provided at an upper end of the developing unit (not illustrated).

The guide frame 10 has a toner feeding hole 11 in fluid communication with a toner discharge hole (not illustrated) provided at the toner cartridge 100. A toner sealing member 12 may be interposed between the toner cartridge 100 and the guide frame 10 so that the toner feeding hole 11 can be in tight contact with the toner cartridge 100.

The toner sealing member 12 is made of a soft material, such as sponge, to prevent toner from leaking toward the guide frame 10 while being discharged through the toner discharge hole, when the toner cartridge 100 is mounted.

However, problem often arises as the toner sealing member 12 is deformed due to an end of the toner cartridge 100 colliding against the toner sealing member 12, as the toner cartridge 100 is pushed in towards the arrowed direction of FIG. 2 to mount.

Because the toner sealing member 12 is made of a soft material such as a sponge, the toner sealing member 12 is compressed by the toner cartridge 100 moving in, thereby being brought into a tight contact with the toner cartridge 100. As the toner sealing member 12 is repeatedly compressed with friction by the toner cartridge 100, over time the bondage to the guide frame 10 is lessened, and in the end, generally the corner of the toner sealing member 12 is detached from the guide frame 10 and curled up or down. If this happens, toner leaks through the space created between the guide frame 10 and the detached corner of the toner sealing member 12.

SUMMARY OF THE INVENTION

The present general inventive concept provides a toner cartridge guiding unit of improved structure to prevent damage to a toner sealing member during mount of a toner cartridge, and an image forming apparatus having the same.

Additional aspects and utilities of the present general inventive concept will be set forth in part in the description which follows and, in part, will be obvious from the description, or may be learned by practice of the general inventive concept.

The foregoing and other aspects and utilities of the present general inventive concept may be achieved by providing a toner cartridge guiding unit, including a guide frame to guide mounting of a toner cartridge, and comprising a toner feed hole formed opposite to a toner discharge hole of the toner cartridge, a toner sealing member attached to the proximity of the toner feed hole, and a lifting unit to raise the toner cartridge so that the toner cartridge does not interfere with the toner sealing member during mounting.

The lifting unit may include a protuberance formed on the guide frame to contact with a bottom side of the toner cartridge, and a protuberance hole formed on the bottom side of the toner cartridge to receive the protuberance therein, when an end of the toner cartridge is past the toner sealing member.

The protuberance may be formed integrally on the guide frame, and round-treated.

The toner cartridge guiding unit may also include a fixing unit to cause the toner cartridge to close contact with the guide frame and to securely fixed in position, during the mounting of the toner cartridge.

The fixing unit may include a plurality of pinholes formed in the guide frame, and a plurality of fixing pins protruding from the toner cartridge to correspond to the pinholes.

The fixing pins may each have a chamfered end. The center axis of each of the pinholes may be lower than the center axis of each of the fixing pins.

The fixing pins may include first fixing pins protruding from the proximity to opposite ends of the toner cartridge, with the center axes being located at the same level with each other, and second fixing pins protruding at the height lower than the center axes of the first fixing pins.

The protuberance hole may include a coring part formed on the bottom part of he toner cartridge.

The foregoing and other aspects and utilities of the present general inventive concept may also be achieved by providing an image forming apparatus, including a main body, a toner cartridge capable of being mounted and demounted to and from the main body, a guide frame to guide the mounting of the toner cartridge, and comprising a toner feed hole formed opposite to a toner discharge hole of the toner cartridge, a toner sealing member attached to the proximity of the toner feed hole, and a lifting unit to raise the toner cartridge so that the toner cartridge does not interfere with the toner sealing member during mounting.

The guide frame may be formed in the main body.

The foregoing and other aspects and utilities of the present general inventive concept may also be achieved by providing an image forming apparatus, including a main body, and a toner cartridge guiding unit having a guide frame to guide a toner cartridge to be mounted to the main body, a toner sealing member attached to the guide frame, and a lifting unit to prevent an interference between the toner sealing member and the toner cartridge during mounting the toner cartridge.

The toner cartridge may move with respect to the guide frame in a direction, and the lifting unit may raise the toner cartridge with respect to the guide frame in a second direction having an angle with the direction to prevent the interference in the direction.

The image forming apparatus may further include a fixing unit to move the raised toner cartridge in a direction opposite to the second direction in which the toner cartridge is raised such that the toner cartridge is mounted to the guide and the main frame in the mounting position.

The lifting unit may be spaced-apart from the toner sealing member by a distance such that the toner cartridge is raised with respect to a portion of guide frame before the interference.

The lifting unit may have a height such that the toner cartridge is raised with respect to a portion of the guide frame before the interference in a mounting direction.

The guide frame may include a bottom formed with the toner sealing member and the lifting unit and to be inserted into the main body together with the toner cartridge, and a side extended from the bottom in a vertical direction to form a portion of an exterior appearance of the main body.

The image forming apparatus may further include a fixing unit having a hole formed on one of the toner cartridge and the side of the guide unit and a pin formed on the other one of the toner cartridge and the side of the guide unit, the lifting unit may raise the toner cartridge with respect to the bottom of the guide frame, and the fixing unit may move the raised toner cartridge to a mounting position.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
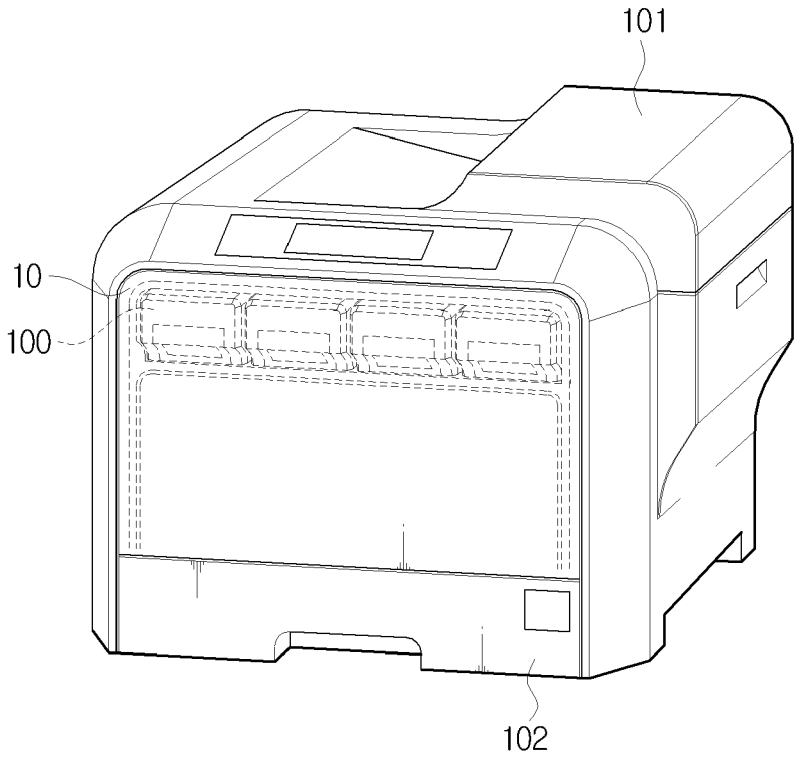
FIG. 1 (PRIOR ART)
FIG. 1 is a perspective view illustrating a conventional color image forming apparatus.
Figure 2:
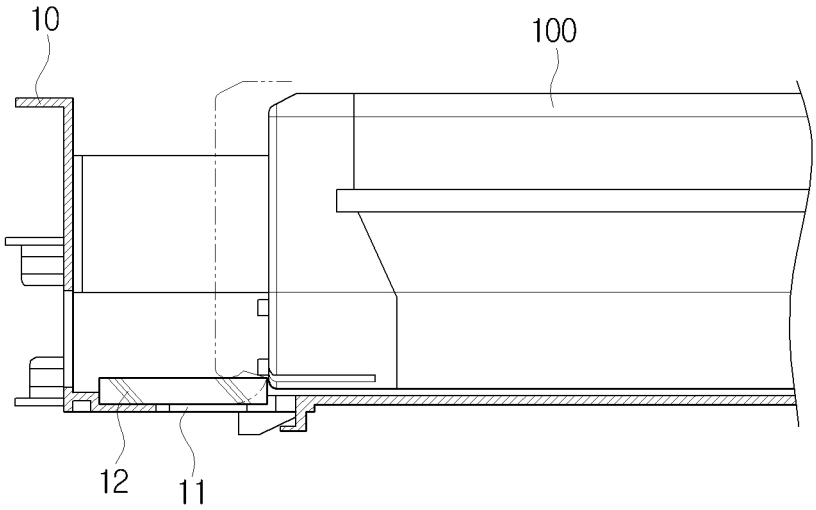
FIG. 2 (PRIOR ART)
FIG. 2 is a side cross section of a toner cartridge of FIG. 1 being mounted.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
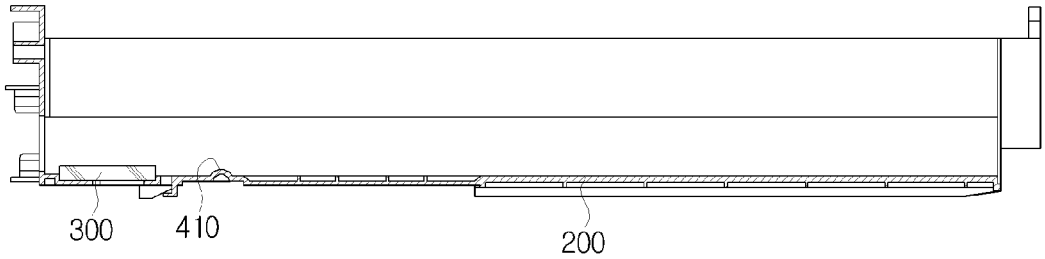
FIG. 3 is a side cross section illustrating a guide frame of a toner cartridge guide unit usable with an image forming apparatus according to an example embodiment of the present general inventive concept.
Figure 4:
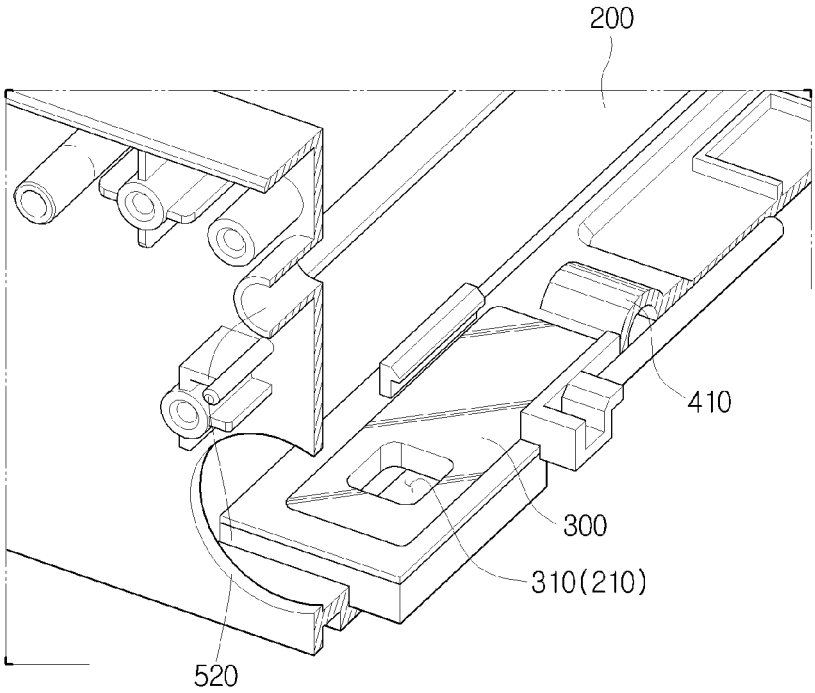
FIG. 4 is a partially-cut, perspective view of the guide frame of FIG. 3.
Figure 5:
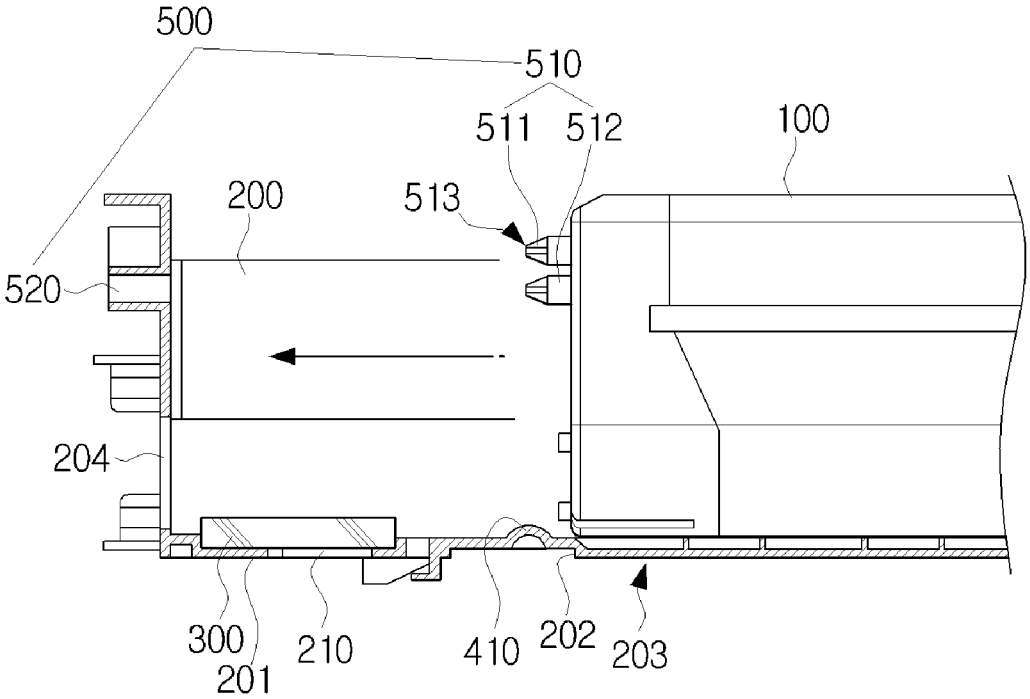
FIG. 5 is a side cross section illustrating a toner cartridge being mounted on the guide frame of FIG. 3.

FIGS. 3, 4, and 5 illustrate a toner cartridge guide unit usable with an image forming apparatus according to an example embodiment of the present general inventive concept. A conventional image forming apparatus of FIG. 1 may be used as the image forming apparatus to be implemented with the toner cartridge guide unit of FIGS. 3, 4, and 5 according to an embodiment of the present general inventive concept.

Figure 6A:
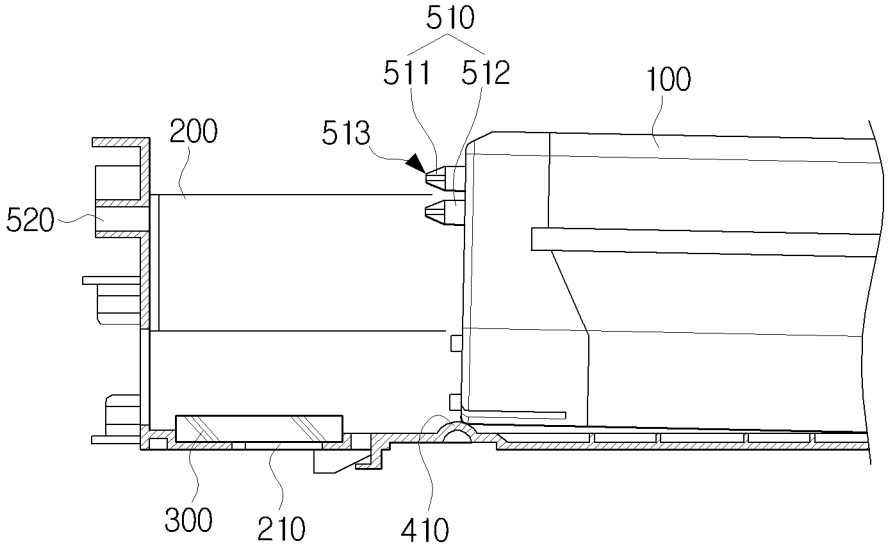
FIGS. 6A to 6E illustrate a method of mounting a toner cartridge using a toner cartridge guide unit in an image forming apparatus according to an example embodiment of the present general inventive concept.
Figure 6B:
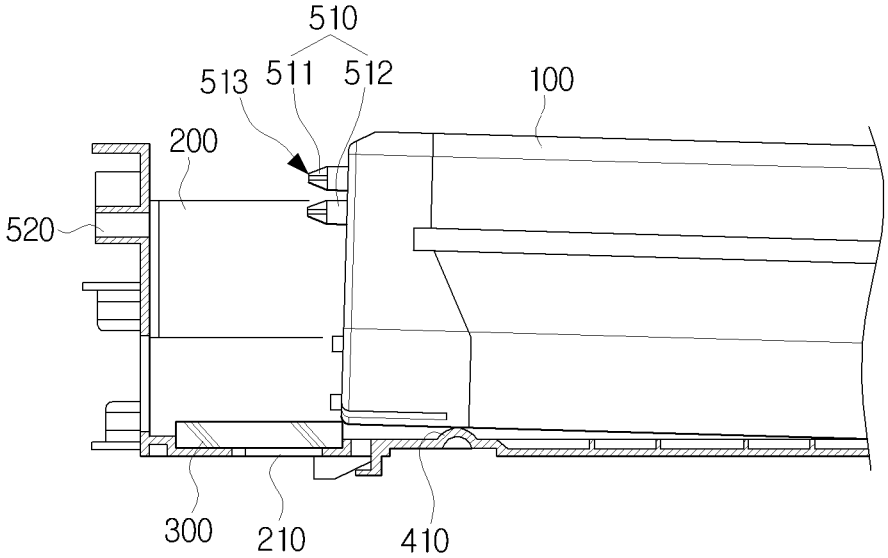
Figure 6C:
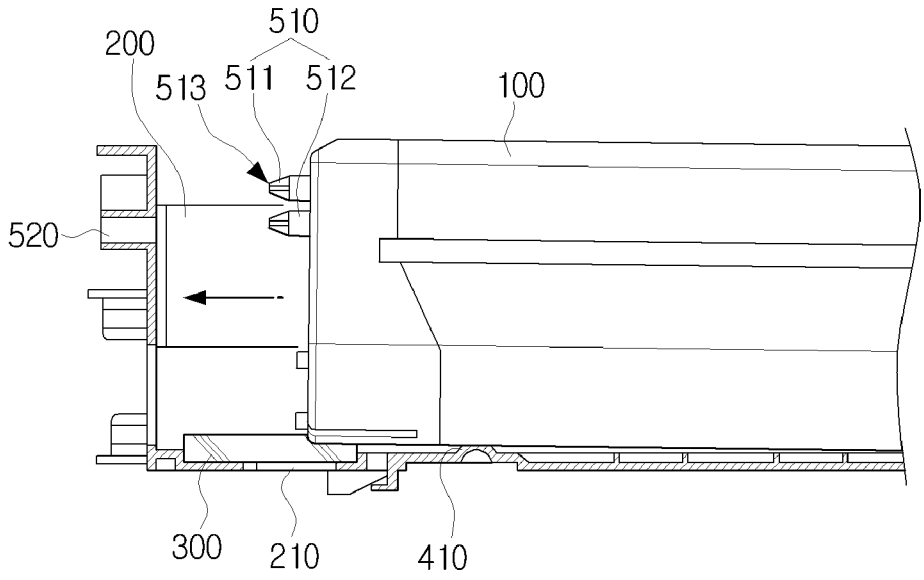
Figure 6D:
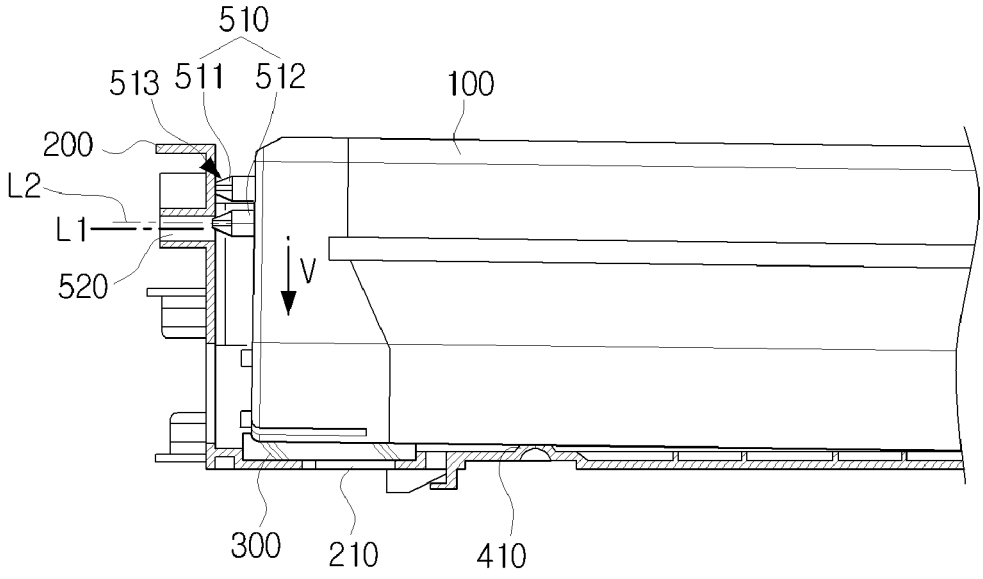
Figure 6E:
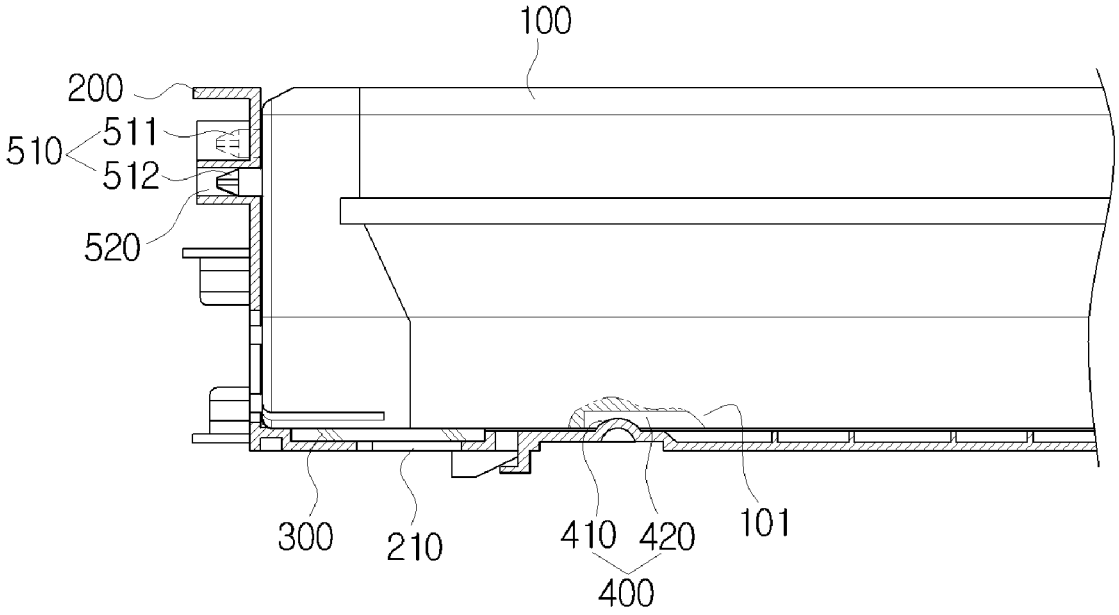

The toner cartridge guide unit includes a toner cartridge 100, a guide frame 200, a toner sealing member 300, and a lifting unit 400 (FIG. 6E).

The toner cartridge 100 holds toner therein. In the implementation of a color image forming apparatus, for example, a plurality of toner cartridges 100 is prepared to hold each of different color toners, including cyan, magenta, yellow, and/or black toners. The toner cartridge 100 has a toner discharge hole (not illustrated) formed in a bottom to discharge the toner therethrough.

Referring to FIGS. 3 and 4, the guide frame 200 is provided on the main body of the image forming apparatus, to guide mounting and demounting of the toner cartridge 100. Referring to FIG. 5, the guide frame 200 includes a bottom 203 having a first portion 201 formed with a toner feed hole 210 at a location to correspond to the toner discharge hole (not illustrated), to convey supplement toner from the toner cartridge 100 toward a toner unit (not illustrated). The toner unit may be a developing unit disposed below the toner cartridge 100 to receive the toner from the toner cartridge 100 through the toner feed hole 210 of the guide frame 100, and to develop an image with the received toner. It is possible that the toner unit may be a developing unit to form a developer using the received toner and to develop an image with the developer.

The toner sealing member 300 is attached to an upper side of the first portion 201 of the bottom 203, to prevent the fed toner of the toner discharge hole (not illustrated) from leaking toward the guide frame 200. A toner passing hole 310 is formed at a center portion of the toner sealing member 300 in a size corresponding to that of the toner feed hole 210. The toner sealing member 300 may be made of a compressible and decompressible porous material such as sponge. The toner is fed to the toner unit through the toner discharge hole of the toner cartridge 100, the toner passing hole 310, and the toner feed hole 210 of the guide frame 100.

The lifting unit 400 moves together with the guide frame 200 in association with the insertion of the toner cartridge 100 into a main body of the image forming apparatus to raise (lift up) the toner cartridge 100, so as to prevent an interference between the toner cartridge 100 and the toner sealing member 300. It is also possible that the lifting unit 400 is associated with the insertion of the toner cartridge 100 into the guide frame 200 in a mounting position on the guide frame 200. Accordingly, the toner sealing member 300 can be prevented from being damaged or deformed when the toner cartridge 100 is inserted into the main body of the image forming apparatus and/or into the guide frame, and the toner discharge hole of the toner cartridge 100 is disposed to correspond to the toner passing hole 310 and the toner feed hole 210 of the guide frame 100 so as to supply the toner from the toner cartridge 100 to the toner unit.

Referring to FIG. 6E, the lifting unit 400 includes a protuberance 410 and a corresponding hole 420.

The protuberance 410 may be integrally formed on a second portion 202 of the bottom 203 of the guide frame 200. The protuberance 410 may be rounded to prevent friction by contact with the toner cartridge 100. The protuberance 410 contacts a lower side of the toner cartridge 100 and lifts the toner cartridge 100 with respect to the bottom 203 of the guide frame 200 before the toner cartridge 100 meets or contacts the toner sealing member 300. It is possible that the protuberance 410 lifts the toner cartridge 100 with respect to the bottom 203 of the guide frame 200 after the toner cartridge 100 contacts an end of the toner sealing member 300.

The protuberance 410 may be spaced-apart from the toner sealing member 300 to lift up an end of the toner cartridge 100 before the toner sealing member 300 is damaged by a movement of the toner cartridge 100. It is also possible that the protuberance 410 may be disposed adjacent to the toner sealing member 300 such that an end of the toner cartridge 10 is lifted up before a contact between the toner cartridge 100 and the toner sealing member 300. The protuberance 410 may have a height enough to lift up the toner cartridge 100 to prevent a direct contact between the toner cartridge 100 and the toner sealing member 300 in a mounting direction of the toner cartridge 100.

The corresponding hole 420 (FIGS. 6E and 7) is formed on a bottom 101 of the toner cartridge 100. Accordingly, the toner cartridge 100 is inserted, with being raised due to the presence of the protuberance 410, and as an end of the toner cartridge 100 passes the toner sealing member 300 or is disposed over the toner cartridge 100, the protuberance 410 is received in the corresponding hole 420. Here, the toner cartridge 100 can be disposed in a fixed position with respect to the guide frame 200 according to a structure of the protuberance 410 of the guide frame 200 and the corresponding hole 420 of the toner cartridge 100.

The corresponding hole 420 may be formed in a configuration corresponding to that of the protuberance 410 on the bottom of the toner cartridge 100. According to an example embodiment of the present general inventive concept, however, it is possible to use a coring portion of the toner cartridge 100 on the bottom portion, by proper fabricating process such as injection molding.

Referring to FIG. 5, the toner cartridge guide unit according to the present general inventive concept may further include a fixing unit 500 to bring the toner cartridge 100 to a close contact with the guide frame 200 and the toner sealing member 300.

The fixing unit 500 includes a plurality of fixing pins 510 formed on the toner cartridge 100, and pinholes 520 formed on a side 204 of the guide frame 200 at locations corresponding to the fixed pins 510 of the toner cartridge 100.

The fixing pins 510 each includes a chamfered part 513 formed at one end thereof. A center axis L1 of the pinhole 520 may be misaligned with a center axis L2 of the fixing pin 510. As illustrated in FIG. 6D, the center axis L1 of the pinhole 520 is lower than the center axis L2 of the fixing pin 510. However, a distance difference between the center axis L1 of the pinhole 520 and the center axis L2 of the fixing pin 510 may be within a predetermined range so as not to cause the fixing pin 510 and the pinhole 520 to be too distanced away from each other to engage each other. For example, the center axis L1 of the pinhole 520 may be kept from the center axis L2 of the fixing pin 510 within a range to receive a distal end of the chamfered part 513, and thus the fixing pin 510 is inserted inwards the pinhole 520, with an inner side of the pinhole 520 contacting the chamfered part 513. When the toner cartridge 100 is completely inserted into and/or mounted on the guide frame 200 and/or the main body of the image forming apparatus, the center axis L1 of the pinhole 520 may be substantially aligned with the center axis L2 of the fixing pin 510.

The fixing pin 510 includes a first fixing pin 511 protruding adjacent to the toner cartridge 100 to the same height, and a second fixing pin 512 protruding approximately from the center part of the toner cartridge 100 to the height lower than the center axis of the first fixing pin 511. In a desirable implementation, one first fixing pin 511 protrudes from one sidewall, the other first fixing pin 511 protrudes from the opposite sidewall, and one second fixing pin 512 protrudes approximately from the center portion. However, the number of the fixing pines 511, 512 may be added or reduced as occasion demands.

An image forming apparatus according to the example embodiment of the present general inventive concept implements a toner cartridge guiding unit in which a main body 101 (FIG. 1) is provided, and a plurality of toner cartridges 100 are removably mounted to the main body 101.

The main body 101 houses an image forming unit, such as a feed unit 102 to hold a plurality of paper sheets, a developing unit (not illustrated), a fusing unit (not illustrated), and a discharge unit (not illustrated). The toner cartridges 100 may hold cyan, magenta, yellow and/or black toners, respectively.

As a printing operation starts, the paper of the feeding unit 102 is transported toward the developing unit so that a color image is formed on the paper. In an image forming apparatus according to an example embodiment of the present general inventive concept, four photosensitive media are provided for four color images. Because one rotation of an intermediate transfer belt enables printing of all these color images at once, high-speed printing is achieved. When an image is formed on a paper sheet, the image is fixed into the paper surface by heat and pressure, and the paper sheet is discharged out of the main body 101 via the discharge unit (not illustrated).

Because the image forming apparatus according to the example embodiment of the present general inventive concept includes toner cartridges 100 as many as the number of colors used therein, a used-up toner cartridge 100 alone can be removed and exchanged with a new one, which is very convenient for a user.

A method of mounting the toner cartridge 100 to the guide frame 200 and/or the main body of the image forming apparatus according to an example embodiment of the present general inventive concept will be explained below, with reference to FIG. 5 and FIGS. 6A to 6E.

Referring to FIG. 5, the guide frame 200 is extracted from the main body of the image forming apparatus, and then the toner cartridge 100 is mounted to the guide frame 200. The toner cartridge 100 is slid with respect to the guide frame 200 in an arrowed direction. As a result, one end of the toner cartridge 100 comes into contact with the protuberance 410 as illustrated in FIG. 6A, and an end of the toner cartridge 100 is lifted with respect to a reference plane of the bottom 203 of the guide frame 200, so that the toner sealing member 300 is not deformed or damaged by the toner cartridge 100 and that the toner sealing member 300 can maintain a sealing structure to prevent the toner from being leaked through a gap between the toner cartridge 100 and the guide frame 200. FIG. 6A illustrates the toner cartridge 100 in an elevated position. That is, a distal end or a portion of the toner sealing member 300 is not detached, deformed, or distorted from the guide frame 200, and the toner sealing member 300 is prevented from losing a sealing characteristic according to a movement of the toner cartridge 100.

FIG. 6B illustrates a state when the toner cartridge 100 is continuously slid with respect to the guide frame 200, and one end of the toner cartridge 100 keeps sliding towards a mounting position as illustrated in FIG. 6E, without having an interference with the toner sealing member 300.

As the toner cartridge 100 moves in, with its end passing the end of the toner sealing member 300 and being placed at the upper side of the toner sealing member 300, the protuberance 410 is received in the corresponding hole 420 formed in the bottom 101 of the toner cartridge 100. As a result, the toner cartridge 100, which was elevated due to the protuberance 410, keeps sliding towards the mounting position. It is possible that the toner cartridge 100 may compress the toner sealing member 300.

As described above, the fixing pins 510 are formed on the end of the toner cartridge 100, and the pinholes 520 corresponding to the fixing pins 510 are formed on the guide frame 200, so that the toner cartridge 100, when finally reaching the mounting position, is fixed in place by the engagement of the fixing pins 510 and the pinholes 520.

Referring to FIG. 6D, because the center axis (L1) of each of the pinholes 520 is lower than the center axis (L2) of each of the fixing pins 510, the toner cartridge 100 is subjected to pressure acting in a direction indicated by arrow V. Accordingly, the inner surfaces of the pinholes 520 contact the chamfered part 513, and the fixing pins 510 are slidingly inserted in the pinholes 520.

Referring to FIG. 6E, when the toner cartridge 100 is inserted and placed in the mounting position, the toner cartridge 100 keeps close contact with the guide frame 200 and the toner sealing member 300.

The guide frame 200 may move with respect to the main body of the image forming apparatus to insert the toner cartridge 100 into the main body of the image forming apparatus. Here, the main body of the image forming apparatus may have a receiving structure to accommodate the toner cartridge 100 and the guide frame 200 in the mounting position. When the toner cartridge 100 is disposed on the guide frame 200, the guide frame 200 is inserted into the receiving structure of the main body of the image forming apparatus. When the guide frame 20 moves with respect to the main body of the image forming apparatus, the toner cartridge 100 moves with respect to the guide frame 200 to the mounting position. It is possible that a convention insertion method of inserting a toner cartridge into a main body can be used as the inserting method according to the present general inventive concept.

Figure 7:
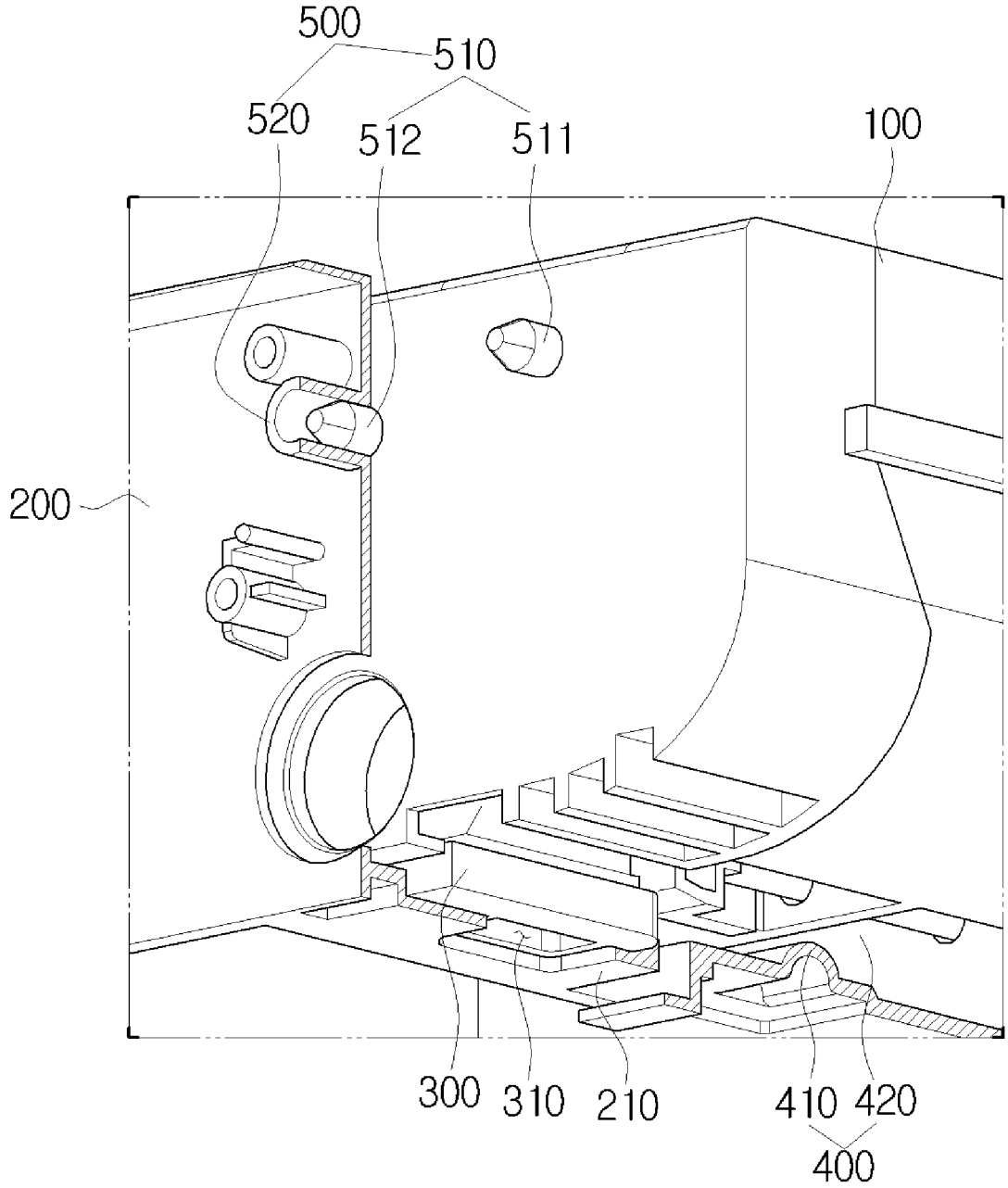
FIG. 7 is a partially cut, perspective view illustrating a toner cartridge in a mounted position according to an example embodiment of the present general inventive concept.

FIG. 7 is a partially cut, perspective view illustrating the toner cartridge 100 in mounting position after having passed the stages explained above.

As described above, the toner discharge hole (not illustrated), the toner feed hole 210, and the toner passing hole 310 correspond to each other when the toner cartridge 100 is at the mounting position. The toner cartridge 100 is fixed in the mounting position by the fixing unit 500. The corresponding hole 420 for the protuberance 410 needs not be fabricated separately, because the coring part, formed in the bottom during the fabrication of the toner cartridge 100, operates as the corresponding hole 420.

In the toner cartridge guiding unit according to the example embodiments of the present invention explained above, the toner cartridge 100 is lifted by the lifting unit 400 before it contacts the toner sealing member 300. Accordingly, an end of the toner cartridge 100 is prevented from colliding against the toner sealing member 300, and subsequently preventing an end of the toner sealing member 300 from curling up or down and being damaged.

Because the toner sealing member 300 is not damaged by the repeated mounting and demounting of the toner cartridge 100, toner is supplied efficiently from the toner cartridge 100, without leaking towards the guide frame 200.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A toner cartridge guiding unit usable with an image forming apparatus, comprising:
- a guide frame to guide mounting of a toner cartridge, and comprising a toner feed hole formed on the guide frame to correspond to a toner discharge hole of the toner cartridge;
- a toner sealing member attached to the proximity of the toner feed hole; and
- a lifting unit to raise the toner cartridge so that the toner cartridge does not interfere with the toner sealing member during mounting of the toner cartridge,
- wherein the lifting unit comprises:
  - a protuberance formed on the guide frame to contact with a bottom side of the toner cartridge; and
  - a protuberance hole formed on the bottom side of the toner cartridge to receive the protuberance therein when an end of the toner cartridge is past an end of the toner sealing member.

2. The toner cartridge guiding unit of claim 1, wherein the protuberance is formed integrally on the guide frame.

3. The toner cartridge guiding unit of claim 2, wherein the protuberance is round-treated.

4. The toner cartridge guiding unit of claim 1, wherein the protuberance hole comprises a coring part formed on the bottom part of the toner cartridge.

5. The toner cartridge guiding unit of claim 1, comprising:
- a fixing unit to cause the toner cartridge to be in close contact with the guide frame and to be securely fixed in a position, during the mounting of the toner cartridge.

6. The toner cartridge guiding unit of claim 5, wherein the fixing unit comprises:
- a plurality of pinholes formed in the guide frame; and
- a plurality of fixing pins protruding from the toner cartridge to correspond to the pinholes.

7. The toner cartridge guiding unit of claim 6, wherein the fixing pins each has a chamfered end.

8. The toner cartridge guiding unit of claim 7, wherein the center axis of each of the pinholes is lower than the center axis of each of the fixing pins when the toner cartridge rests on the toner sealing member and the fixing pins are outside the pinholes.

9. The toner cartridge guiding unit of claim 8, wherein the fixing pins comprise:
- first fixing pins protruding from the proximity to opposite ends of the toner cartridge, with the center axes being located at the same level with each other; and
- second fixing pins protruding at the height lower than the center axes of the first fixing pins.

10. An image forming apparatus, comprising:
- a main body;
- a toner cartridge to be mounted to and demounted from the main body;

a guide frame to guide the mounting of the toner cartridge, and comprising a toner feed hole formed on the guide frame to correspond to a toner discharge hole of the toner cartridge;

a toner sealing member attached to the proximity of the toner feed hole; and a lifting unit to raise the toner cartridge so that the toner cartridge does not interfere with the toner sealing member during mounting of the toner cartridge, wherein the lifting unit comprises:

a protuberance formed on the guide frame to contact with a bottom side of the toner cartridge; and a protuberance hole formed on the bottom side of the toner cartridge to receive the protuberance therein when an end of the toner cartridge is past an end of the toner sealing member.

11. The image forming apparatus of claim 10, wherein the protuberance hole comprises a coring part formed on the bottom part of the toner cartridge.

12. The image forming apparatus of claim 10, comprising a fixing unit to cause the toner cartridge to close contact with the guide frame and to securely fixed in position, during the mounting of the toner cartridge.

13. The image forming apparatus of claim 12, wherein the fixing unit comprises:

a plurality of pinholes formed in the guide frame; and a plurality of fixing pins protruding from the toner cartridge to correspond to the pinholes.

14. The image forming apparatus of claim 10, wherein the guide frame is formed in the main body.

* * * * *